US005460572A

United States Patent [19]

Waltz et al.

[11] Patent Number: 5,460,572

[45] Date of Patent: Oct. 24, 1995

[54] FOUNDATION VENTILATOR

[75] Inventors: Arthur L. Waltz, Ridgefield; David A. Waltz, Vancouver, both of Wash.

[73] Assignee: Vent Air Inc., Vancouver, Wash.

[21] Appl. No.: 64,404

[22] Filed: May 18, 1993

Related U.S. Application Data

[63] Continuation-in-part of Ser. No. 625,009, Dec. 10, 1990, abandoned, which is a continuation-in-part of Ser. No. 121,345, Nov. 16, 1987, abandoned, which is a continuation-in-part of Ser. No. 29,415, Mar. 23, 1987, abandoned, and a continuation-in-part of Ser. No. 29,414, Mar. 23, 1987, abandoned, and a continuation-in-part of Ser. No. 47,444, May 11, 1987, abandoned, and a continuation-in-part of Ser. No. 47,445, May 11, 1987, abandoned.

[51] Int. Cl.[6] ..... F24F 7/00

[52] U.S. Cl. ..... 454/273; 52/302.1; 454/271

[58] Field of Search ..... 454/270, 271, 454/272, 273, 274; D23/381, 393; 52/302, 656, 302.1, 656.2, 656.8

[56] References Cited

U.S. PATENT DOCUMENTS

| | | | |
|---|---|---|---|
| D. 258,985 | 4/1981 | Peirce et al. | D23/381 |
| D. 259,736 | 6/1981 | Peirce et al. | D23/381 |
| D. 260,117 | 8/1981 | Peirce et al. | D23/381 |
| D. 269,293 | 6/1983 | Peirce et al. | D23/381 |
| D. 269,700 | 7/1983 | Peirce et al. | D23/381 |
| D. 277,026 | 1/1985 | Waltz et al. | D23/381 |
| D. 277,027 | 1/1985 | Waltz et al. | D23/381 |
| D. 277,028 | 1/1985 | Waltz et al. | D23/381 |
| D. 277,229 | 1/1985 | Williamson et al. | D23/381 |
| D. 277,230 | 1/1985 | Williamson et al. | D23/381 |
| D. 277,312 | 1/1985 | Williamson et al. | D23/381 |
| D. 277,502 | 2/1985 | Williamson et al. | D23/381 |
| 1,673,379 | 6/1928 | Swift . | |
| 2,565,122 | 8/1951 | Cowan . | |
| 3,220,079 | 11/1965 | Aggson . | |
| 4,026,082 | 5/1977 | Crofoot . | |
| 4,669,371 | 6/1987 | Sarazen, Jr. et al. . | |

FOREIGN PATENT DOCUMENTS

| | | |
|---|---|---|
| 278221 | 10/1951 | Switzerland . |
| 2541 | of 1890 | United Kingdom . |
| 8210 | of 1897 | United Kingdom . |

*Primary Examiner*—Harold Joyce
*Attorney, Agent, or Firm*—R. Reams Goodloe, Jr.

[57] ABSTRACT

A one piece molded plastic foundation ventilator. The ventilator includes a one-piece continuous and structurally jointless plastic tubular member having a first through passageway, with the tubular member having a front and a rear, and with the through passageway of the ventilator including a portion between the front and the rear having a smaller cross-sectional dimension than the front, and having a smaller cross-sectional dimension than the rear. The front and rear of the ventilator includes outwardly directed flange portions. The ventilator may be supplemented by the addition of a screen and a hinged cover with securing latches.

21 Claims, 10 Drawing Sheets

FOUNDATION VENTILATOR

RELATED APPLICATIONS

This application is a Continuation-in-Part of prior application Ser. No. 07/625,009, filed Dec. 10, 1990, now abandoned, which was a Continuation-in-Part of application Ser. No. 07/121,345, filed Nov. 16, 1987, now abandoned, which was a Continuation-in-Part of the following applications: U.S. Ser. Nos. 07/029,415, filed Mar. 23, 1987, now abandoned; 07/029,414, filed Mar. 23, 1987, now abandoned; 07/047,444, filed May 11, 1987, now abandoned; and 07/047,445, filed May 11, 1987, now abandoned.

TECHNICAL FIELD OF THE INVENTION

This invention relates to devices for the ventilation of foundations of building structures, and to methods for manufacturing such devices.

BACKGROUND

In the construction of simple structures such as a house or a light commercial building, a number of different types of foundation designs may be utilized. Some of the most commonly used designs include (a) a concrete slab, over which the structure is built, (b) a subgrade basement, over which the structure is built, (c) post-and-pillar construction, where vertical posts rise from footings, and the posts are used to support girders, upon which the building is constructed, and (d) stem wall construction, where a poured vertical concrete wall forms the support for the structure.

In the popular stem wall construction technique, concrete forms are positioned at desired locations on the ground. Then, concrete is poured into these forms to (a) provide a footing, and (b) to form a vertical stem wall. When the concrete sets in the wall forms, there results a vertical concrete stem wall. A frame building is then constructed above the vertical stem wall. A crawl space is provided underneath the frame building; the crawl space normally provides a minimum of about eighteen (18) inches of vertical space between the ground and the bottom of the frame structure. The crawl space is also an air ventilation space. This is important since without air circulation underneath the frame building, there may be damage, such as dry rot, due to presence of moisture or condensation beneath the frame structure. However, in order to have an air ventilation space, it is necessary to have a means for passage of air through the concrete wall. Our invention is directed to a novel ventilation apparatus for placement in vertical concrete walls to allow air to pass therethrough.

Generally, there have been developed a wide variety of devices which may be utilized to provide ventilation means in walls. With respect to stem type walls, number of such devices are known. In the patent literature, U.K Patent No. 8210, issued Mar. 5, 1898 to Tiltman for IMPROVEMENTS IN VENTILATORS, U.S. Pat. No. 3,220,079 issued Nov. 30, 1965 to Aggeson for FOUNDATION VENT, and U.S. Pat. No. 4,026,082 issued May 31, 1977 to Crofoot for VENT FRAMES, are the closest utility patents of which we are aware. Other important art of which we are aware includes our own designs: U.S. Pat. No. Des. 258,985 issued Apr. 21, 1981 to Peirce et al. for VENTILATOR SECTION; U.S. Pat. No. Des. 259,736 issued Jun. 30, 1981 to Peirce et al. for VENTILATOR SECTION; U.S. Pat. No. Des. 260, 117 issued Aug. 4, 1981 to Peirce et al. for VENTILATOR SECTION; U.S. Pat. No. Des. 269,293 issued Jul. 7, 1983 to Peirce et al. for VENTILATOR; and U.S. Pat. No. Des. 269,700 issued Jul. 12, 1983 to Peirce et al. for VENTILATOR.

In so far as we are aware, the patent documents identified in the proceeding paragraph, with the exception of Tiltman, disclose ventilators with multi-piece construction. The Tiltman patent discloses a cast iron wall sleeve for use in a ventilator device, but does not address the construction of a low cost plastic ventilator, nor does Tiltman suggest the desirability of varying the cross-sectional area of the ventilator from front to back. Although our multi-part ventilators, shown in U.S. Pat. No. Des. 269,293 and Des. 269,700, disclose ventilators which upon first impression are similar in appearance to the present invention, nevertheless they did not teach the advantages of one-piece molded construction of according to our present invention. In order to reduce fabrication costs, to improve ventilator strength, and to reduce deformation during the concrete pouring process, there exists a continuing need in the art for an improved ventilator design, and for an improved method of fabricating a ventilator.

SUMMARY

We have now invented, and disclose herein, a novel one-piece molded plastic ventilator which is like those heretofore proposed in that it provides a stair-step or telescoping shaped construction. Our novel molded plastic ventilator varies from those of this type heretofore proposed in that the base is of seamless, one-piece, molded plastic unitary construction. Thus, it does not have seams for leakage of concrete therethrough, nor does it require fasteners to fabricate a completed ventilator from two complementary parts. Further, the one piece ventilator may be made from any convenient moldable plastic, such as polystyrene, polyethlyene, or the like, and eliminates the need to build such devices from metal or multiple plastic parts.

In addition to the molded one-piece base, our ventilator may also provide a screen and a latching door. Moreover, my one-piece molded plastic ventilator is simple, relatively inexpensive, easy to manufacture; it provides superior non-leaking and non-deforming performance during fabrication of the typical concrete stem wall, and is otherwise superior to the heretofore proposed ventilation devices of which we are aware.

In general, ventilators employing the principles of the present invention include a continuous one-piece molded plastic tubular member having a first through passageway, with the tubular member having a front and a rear, and with the through passageway of the ventilator including a portion between the front and the rear having a smaller cross-sectional dimension than the front, and having a smaller cross-sectional dimension than the rear.

Ideally, the front and rear of the ventilator includes outwardly directed flange portions. The flanges are suitable for positioning the ventilator between wall forms during fabrication of a concrete wall; therefore the flanges normally include convenient nailing holes for secure positioning of the ventilator when setting up the wall forms, prior to pouring any concrete.

For strength, the front flange portion of the one-piece molded plastic ventilator joins a first inwardly projecting ringlike band or side which in turn unites with a first downward ledge, which in turn unites with a second, smaller inwardly projecting ringlike band or side. This stair stepping or expanding telescope type shape is repeated as many times as desired to achieve the minimum central cross sectional area desired, or as is necessary to provide adequate structural strength given the size of the vent, and whereupon the stairstep or telescoping process is reversed. Then, the rear of the smallest ringlike band or side unites with a first upwardly projecting ledge, and which in turn unites with a larger ringlike band or side. That larger ringlike band or side may join the rear flange, or additional ringlike bands or sides and upwardly projecting ledges may be inserted as necessary for strength and to achieve the width required.

In embodiment, the one-piece molded plastic foundation ventilator comprises a tubular member having a first through passageway, with the tubular member having a front and having a rear wherein a part of the passageway positioned between the front and the rear has a smaller cross-sectional dimension than the rear. A vertical support and reinforcing divider defines the first through passageway and also defines a second through passageway. The front includes an outwardly directed front flange and the rear includes an outwardly directed rear flange. The front flange unites with an inward projecting ringlike or circumscribing first side which in turn unites with a first inward ledge, which in turn unites with an inward projecting ringlike or circumscribing second side, which in turn unites with a second inward ledge. The second inward ledge unites with a ringlike or circumscribing third side. The third side may unite with a fourth side, without a ledge portion intervening, or the third side may unite with a third inward ledge, which ledge in turn unites with a fourth ringlike or circumscribing side. The fourth ringlike circumscribing side unites with a fourth ledge portion, which in turn unites with a fifth ringlike circumscribing side. The fifth ringlike circumscribing side unites with the rear flange portion.

The one-piece molded plastic ventilator may be supplemented by the addition of a porous member or screen, embedded in the through passageways to allow the passage of gas and to preclude the passage of solid through the passageways.

Additionally, within the front portion of each through passageway, a cover means may also be affixed. The cover is operatively connected with, or may integrally include, a hinge means for permitting the cover to move from an open position (allowing air passage therethrough) to a closed position (substantially preventing air passage therethrough). There is a substantially horizontal inner ledge projecting forward from adjacent the hinge means position of the cover toward the front of the ventilator. The cover includes tab means at the lateral reaches thereof suitable for operatively interacting with the horizontal ledge to snap the cover in an open position. Latch means is included at the upper reaches of the through passageway to snap the cover means in a closed position. Both the open position tab-latch and the closed position snap latch rely on the flexibility of the cover means to slightly deform while moving from the latched to the unlatched position, and vice-versa.

When used in construction, the molded plastic one-piece ventilator is securely positioned to (between) the wall forms used for receiving the concrete. The concrete is poured into the forms and agitated so as to flow around the one-piece unitary plastic ventilator. After the concrete has set, the forms can be removed so as to leave a vertical wall. Then, the one-piece molded plastic foundation ventilator allows the circulation of air into and out of the crawl space defined by the ground, the vertical stem wall and the lower part of the frame building.

The novel, one-piece molded plastic foundation ventilator described herein represents a significant improvement in the art. Although in the past there have been a molded plastic ventilators prepared from two or more individual plastic sections that are joined by fasteners or otherwise into an single unit, in so far as we are aware, it has heretofore not been proposed to provide an integral, one-piece molded ventilator. Our one-piece molded plastic ventilator design eliminates seams or joints in the ventilator air flow passageways, thus eliminating the possibility of leakage of concrete through such seams during construction. Also the one-piece molded construction of our ventilator eliminates the necessity for fasteners to join vent sections, thus reducing fabrication costs. Further, we have found that our one-piece molded plastic ventilator provides excellent strength when compared to prior fabricated multiple part ventilators; this is important in construction since concrete is quite heavy and deformation of multi-piece plastic ventilators has been a continuing problem.

OBJECTS, ADVANTAGES AND FEATURES OF THE INVENTION

From the foregoing, it will be evident to the reader that the primary object of the present invention resides in the provision of a novel one-piece molded plastic foundation ventilator.

It is a further object of the present invention to provide a foundation ventilator:

- which utilizes a minimum of plastic material;
- which minimizes assembly labor;
- which avoids the use of fasteners or hot melt operations for assembly;
- which cannot leak through joints or cracks when concrete is poured therearound;
- which resists deformation when loaded with the weight of wet concrete thereabove.

Other also important but more specific objects of the invention reside in the provision of a molded, one-piece plastic foundation ventilator in accord with the preceding objects:

- which allow one to preselect the size of the ventilator so a unit of appropriate size can be mounted between concrete wall forms of corresponding preselected width to achieve the proper fit in a cured concrete wall;
- which is capable of resisting deterioration by corrosion or erosion during many years of use;
- which is rugged and durable;
- which, in conjunction with additional hinged doors, can be manually opened or closed to facilitate the correct ventilation flow for the prevailing environmental conditions;
- which is easy to install by unskilled or semi-skilled labor;
- which, in conjunction with the preceding objects, is so designed that the ventilation apparatus provides a means of air flow to and from a crawl space below a building structure.

One of primary advantages of the present invention is that less manual labor is needed in the manufacture of the ventilator. With the heretofore known two-piece foundation ventilator it was necessary to manufacture the two pieces and then join the two pieces to form a finished ventilator. This required extra handling of the pieces. A party would manufacture the two pieces. Often, then the two pieces would have to be packed into containers and transported to an assembly shop. At the assembly shop the two pieces would have to be unpacked from the containers and formed into finished ventilator. With a one piece ventilator it is not necessary to pack two different pieces and ship to an assembly plant, unpack and then assemble. With a one-piece ventilator the ventilator is completely formed at the plastic manufacturing, i.e. injection molding shop. With a one piece ventilator there is less labor involved and therefore less cost in the manufacture of the ventilator. Also, with a two piece design, it is necessary to have additional plastic to form flanges for the fasteners or connecting pins. Thus, with a one-piece ventilator there is less plastic used as it is not necessary to have fasteners or connecting pins connecting two pieces of plastic. The net result is that there is (a) a savings in labor, and (b) a savings in plastic, which means a less expensive ventilator.

While the present invention is generally described with reference to and as an improvement upon earlier multi-part plastic foundation ventilators, it should be understood that the one-piece molding process for fabrication of foundation ventilators may be suitable for utilization in the fabrication of a variety of designs of foundation ventilators.

Other important objects, features and additional advantages of the invention will be apparent to the reader from the foregoing and the appended claims and as the ensuing detailed description and discussion of the invention proceeds in conjunction with the accompanying drawing.

BRIEF DESCRIPTION OF THE DRAWING

The invention may be better understood by reference to the accompanying drawing, wherein.

DESCRIPTION

A stem wall may be many thicknesses Two standard thicknessess for a stem wall are a six inch thickness and an eight inch thickness. Generally, for a one story frame building the stem wall may be six inches thick, whereas for a two story frame building, the stem wall may be eight inches thick.

This invention is directed to a one piece, structurally jointless foundation ventilator which may be fabricated in a pre-selected thickness for use in the construction of stem walls of corresponding thickness. The foundation ventilator is fabricated by molding in one continuous piece, thus there are no joints resulting from fastening structural halves together. Any suitable plastic may be utilized for the vent materials, such as polystyrene, polyethlyene, polyvinylchloride, or other easily moldable, preferably injection moldable, plastics.

Figure 2:
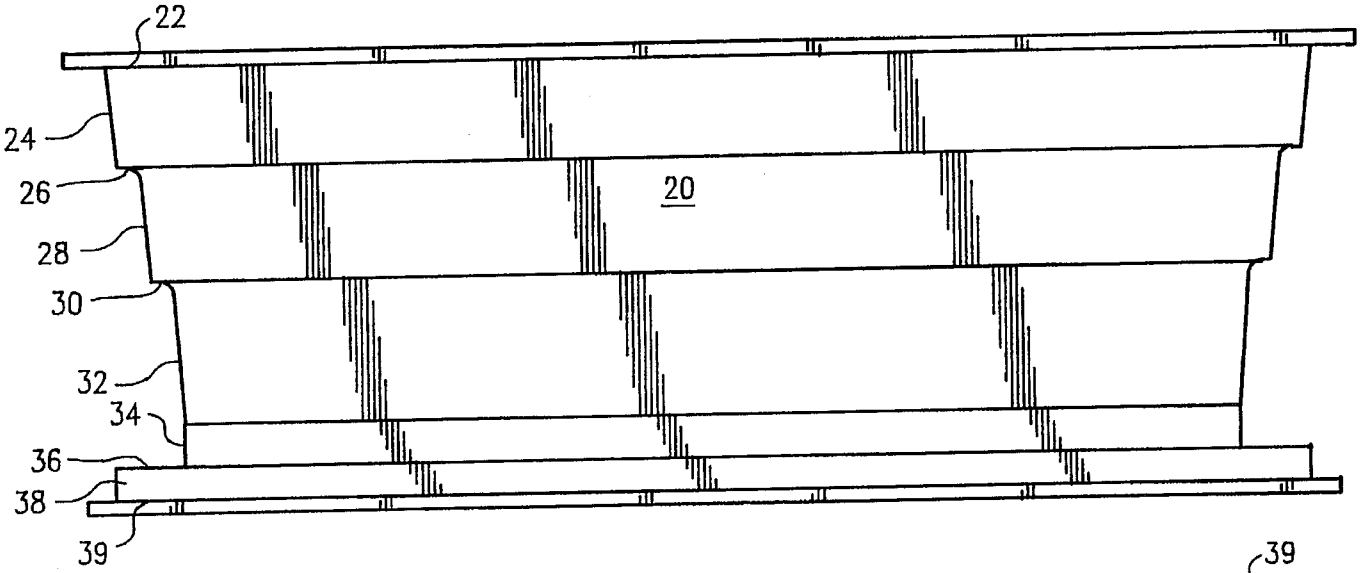
FIG. 2 is a top plan view of a unitary one-piece molded plastic foundation ventilator.
Figure 3:
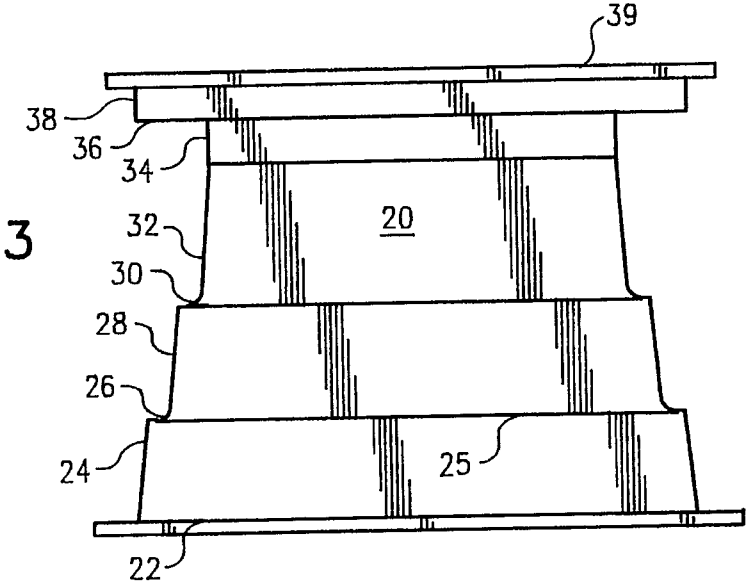
FIG. 3 is an end elevation view of a unitary one-piece molded plastic foundation ventilator.

Attention is directed to FIGS. 2 and 3, where there is shown a top plan view and an end elevation view, respectively, of one-piece molded plastic foundation ventilator 20. It is seen that the ventilator 20 includes a front outwardly directed flange 22. An inwardly projecting and preferably sloping ringlike or circumscribing first side 24 joins flange 22. Then, at the inward side 25 of ringlike first side 24, first side 24 joins with a first inward ledge 26. First inward ledge 26 serves to reduce the cross-sectional area of the interior through passageway (shown below) defined by the second ringlike circumscribing side 28 when compared to the cross-sectional area of the interior through passageway (shown below) of the first side 24. Then, first inward ledge 26 in turn joins a second inwardly projecting and preferably sloping ringlike or circumscribing second side 28. The second side 28 joins with a second inward ledge 30 which in turn joins with an inwardly projecting and preferably sloping ringlike circumscribing third side 32. The third side 32 joins with an outwardly projecting and preferably outwardly sloping ringlike and circumscribing fourth side 34. The fourth side 34 meets with a third ledge 36, which third ledge provides outward expansion of the interior of the vent 20. The third ledge 36 joins the outwardly projecting and preferably outwardly sloping ringlike circumscribing fifth side 38. At the outer or rearward edge of fifth side 38 there is an outwardly directed rear flange 39.

Figure 11:
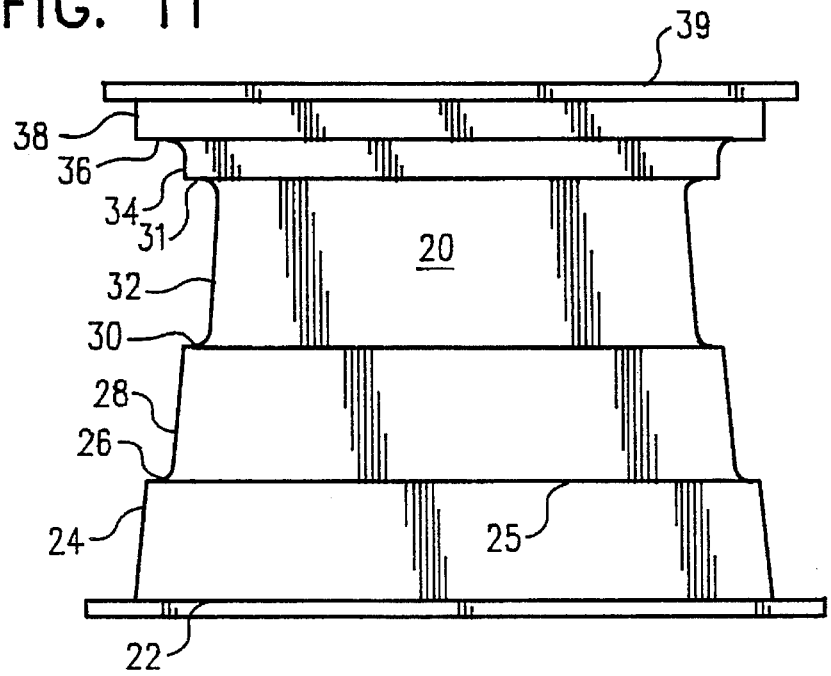
FIG. 11 is an end elevation view of another embodiment of our unitary one-piece molded plastic foundation ventilator.
Figure 12:
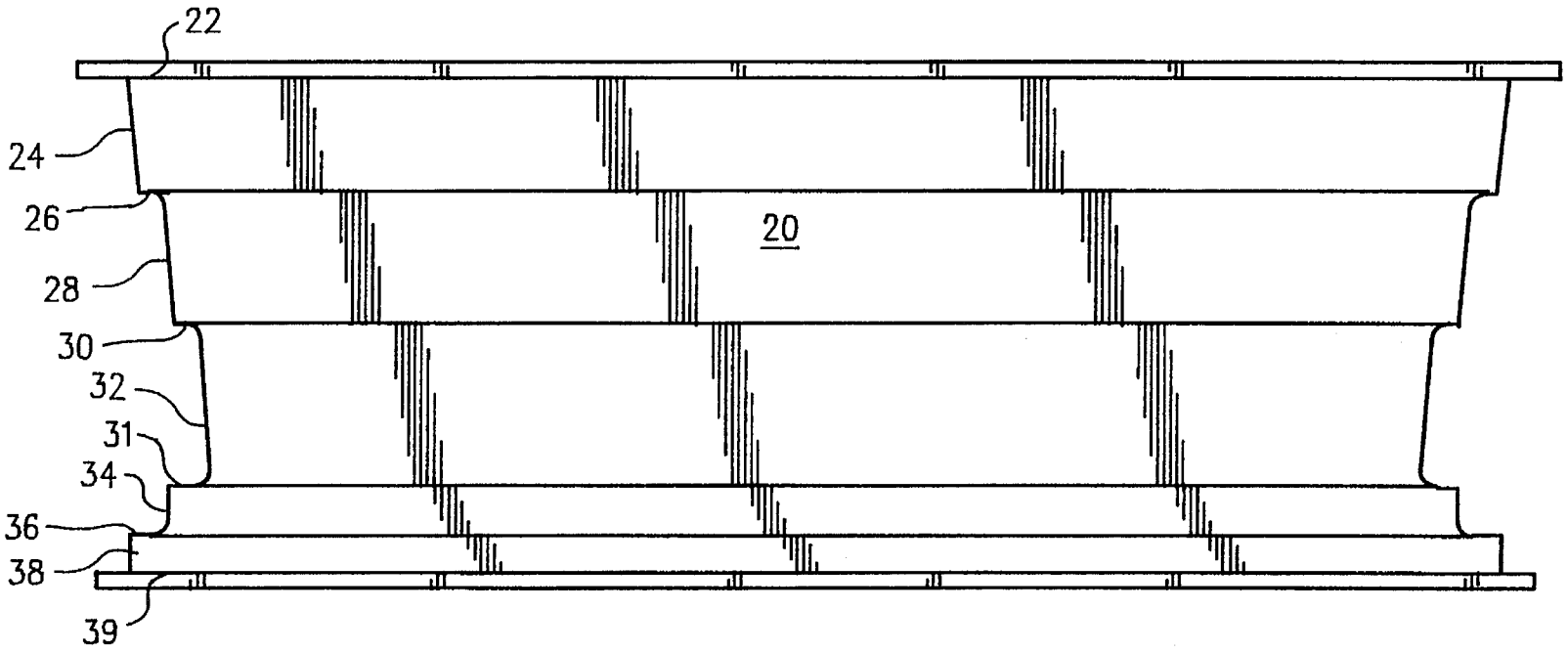
FIG. 12 is a top plan view of the embodiment of our unitary one-piece molded plastic foundation ventilator first set forth in FIG. 11 above.

Thus, it can be appreciated that the downward stair stepping or expanding telescope type shape is repeated as many times as desired to achieve the minimum central cross sectional area desired at the middle portion of the vent in the through passageway direction, or as may be necessary to provide adequate structural strength given the size of the vent 20, whereupon the stairstep or telescoping process is reversed. Then, the rear of the smallest ringlike band or side unites either with another rearwardly projecting ringlike side (as is shown in FIGS. 2 and 3) or with an outwardly projecting first outer ledge (such as ledge 31 as shown in FIGS. 11 and 12 below) which in turn unites with the next ringlike side, and then a with a second outwardly projecting ledge, and which in turn unites with a larger ringlike band or side, which ultimately joins a final outwardly projecting ledge. Then, a final ringlike band or side joins the rear flange. As many additional ringlike bands or sides and inwardly (at the front portion) or outwardly (at the rear portion) projecting ledges may be inserted as necessary for strength and to achieve the width required.

As shown in FIGS. 2 and 3, ideally, each ringlike band or side (here, sides 24, 28, 32, 34, and 38) is in the one (1) inch range, and generally only slightly more than one (1) inch or so in depth (front to rear), and normally for strength each it is desirable that each side is not significantly more than three (3) inches in depth. We have found that ledges (here, 26, 30, and 36) between about one quarter (¼) inch to one-half (½) inch in height provide sufficient strength, however, the actual size may be more or less and is not critical to achieving the results taught herein.

Figure 4:
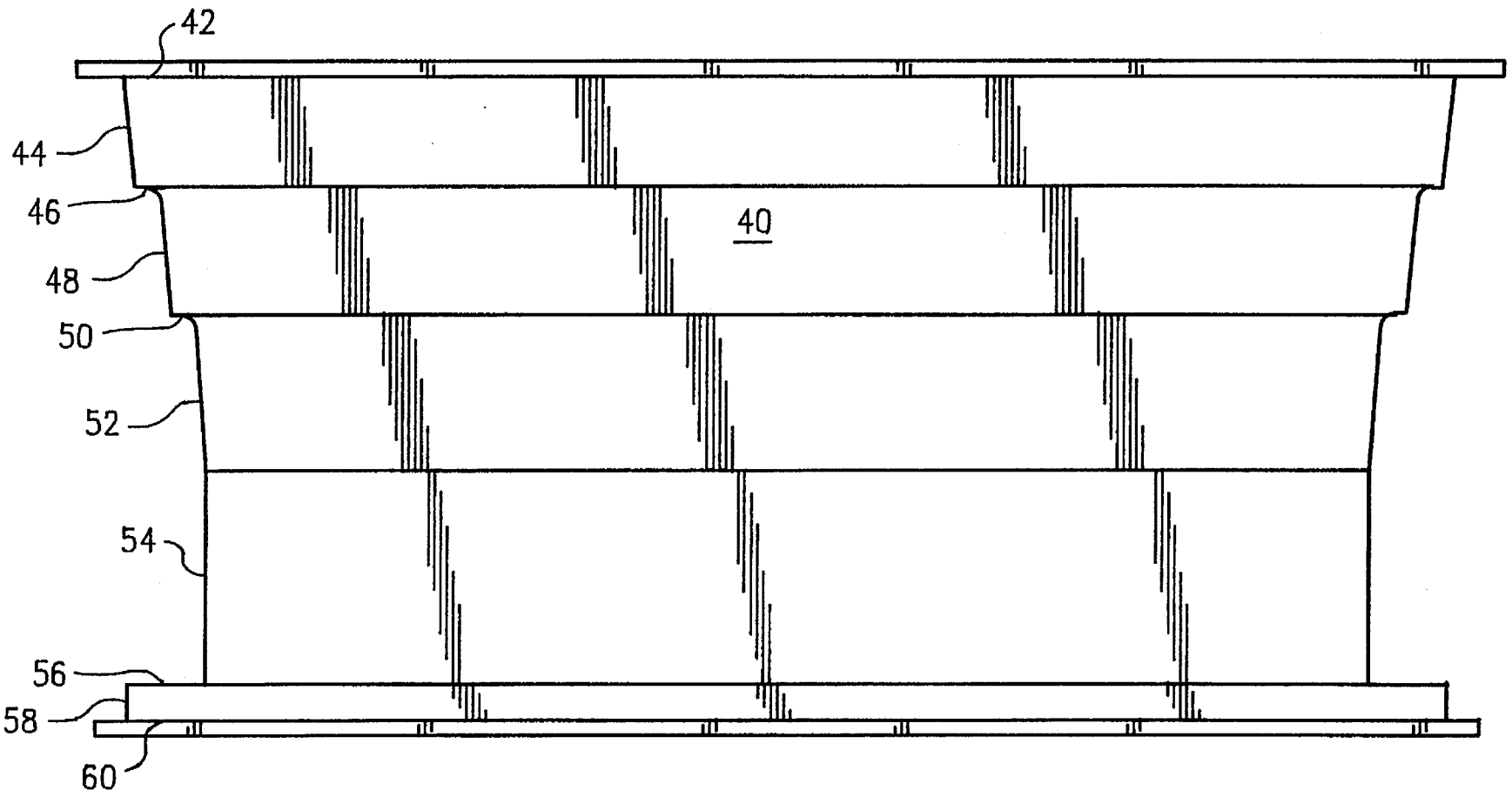
FIG. 4 is a top plan view of a second embodiment of a unitary one-piece molded plastic foundation ventilator.
Figure 5:
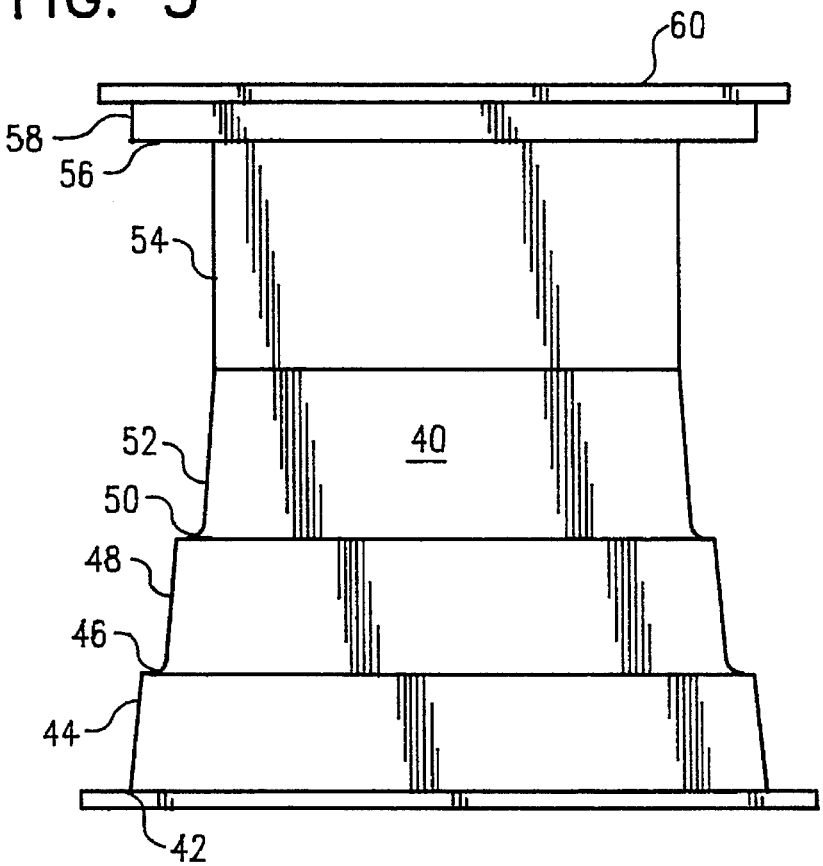
FIG. 5 is an end elevation view of the second embodiment of the unitary one-piece molded plastic foundation ventilator first illustrated in FIG. 4 above.

In FIGS. 4 and 5, there is are shown a top plan view and an end elevation view, respectively, of another unitary one-piece molded continuous uninterrupted plastic foundation ventilator 40. Although structurally the ventilator 40 is quite similar to ventilator 20, the views of FIGS. 2 and 3 are configured to show the shape of a desirable six (6) inch depth ventilator 20, and the view of FIGS. 4 and 5 are configured to show the shape of a desirable eight (8) inch ventilator 40.

The ventilator 40 has a front outwardly directed flange 42 which joins with an inward projecting and preferably inwardly sloping ringlike or circumscribing first side 44. First side 44 joins with a first inward ledge 46 which in turn joins with a inwardly projecting and preferably inwardly sloping ringlike or circumscribing second side 48. Second side 48 joins with a second inward ledge 50. The second inward ledge 50 in turn meets with a inwardly projecting and preferably inwardly sloping ringlike or circumscribing third side 52. Third side 52 meets with an outwardly projecting or preferably outwardly sloping circumscribing fourth side 54. Fourth side 54 joins at the third inward ledge 56 to a ringlike or circumscribing fifth side 58. At the outer reaches of fifth side 58, there is an outwardly directed rear flange 60.

A comparison of the foundation ventilator 20 and the foundation ventilator 40 shows that the main difference is the thickness of the fourth side 34 of the ventilator 20 as compared with the fourth side 54 of the ventilator 40. It can be appreciated that with a six (6) inch vent 20 and an eight (8) inch vent 40, the fourth side 54 of the ventilator 40 is about two (2) inches wider than the fourth side 34 of the ventilator 20. The front flanges 22 and 42 correspond. The width of first sides 24 and 44 correspond. The inward depth of first ledges 26 and 46 correspond. The width of second sides 28 and 48 correspond. The inward depth of second ledges 30 and 50 correspond. The width of third sides 32 and 52 correspond. The width of fifth sides 38 and 58 correspond. The size of rear flanges 39 and 60 correspond. Again, the primary difference in one embodiment of the six (6) inch and eight (8) inch plastic foundation ventilators resides in the width of the fourth sides 34 and 54 of the six and eight inch ventilators, respectively.

Figure 6:
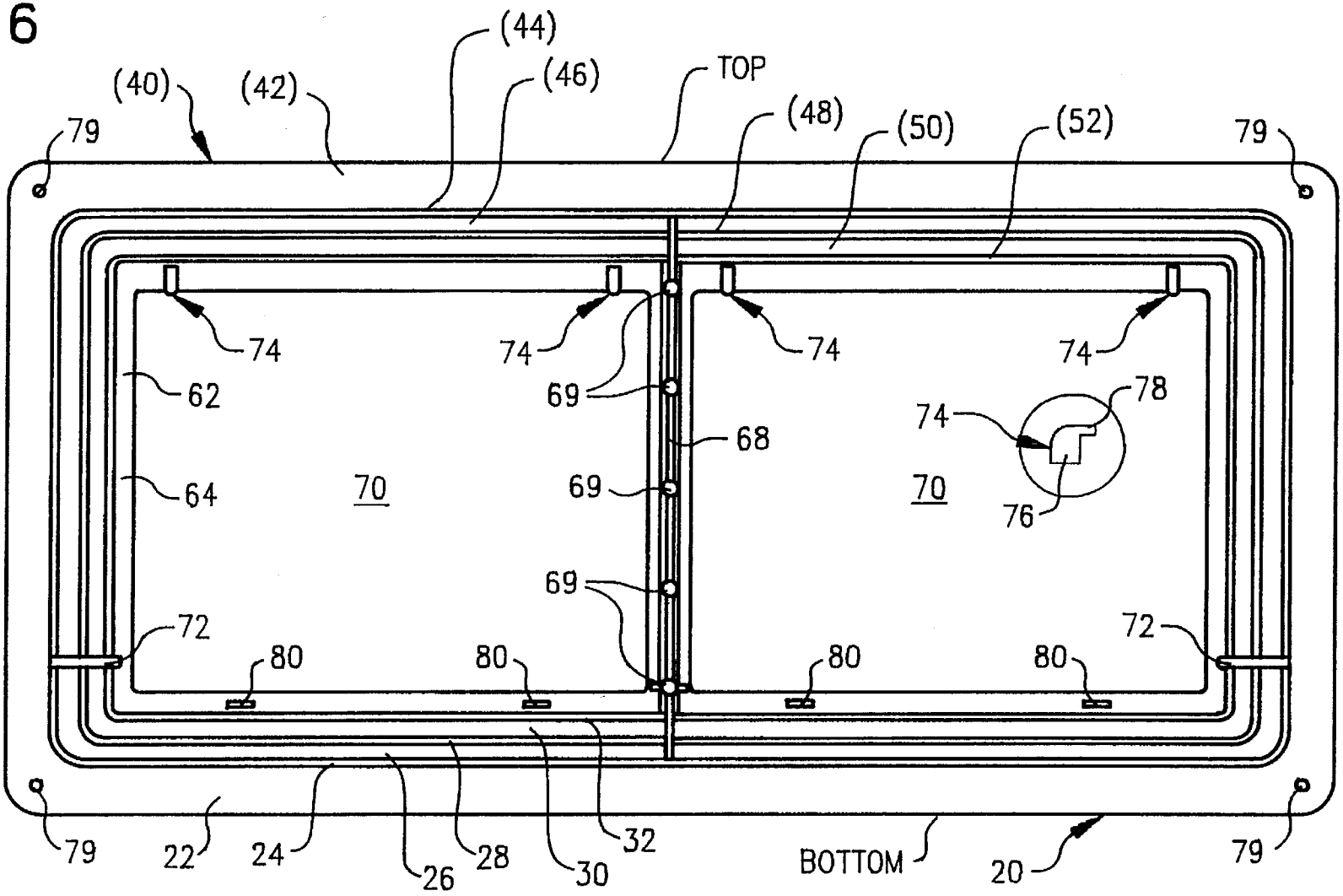
FIG. 6 is a front elevation view of a unitary one-piece molded plastic foundation ventilator.

FIG. 6 is a front elevation view of the foundation ventilator 20; the front view of a larger ventilator such as ventilator 40 is virtually indentical.

Figure 7:
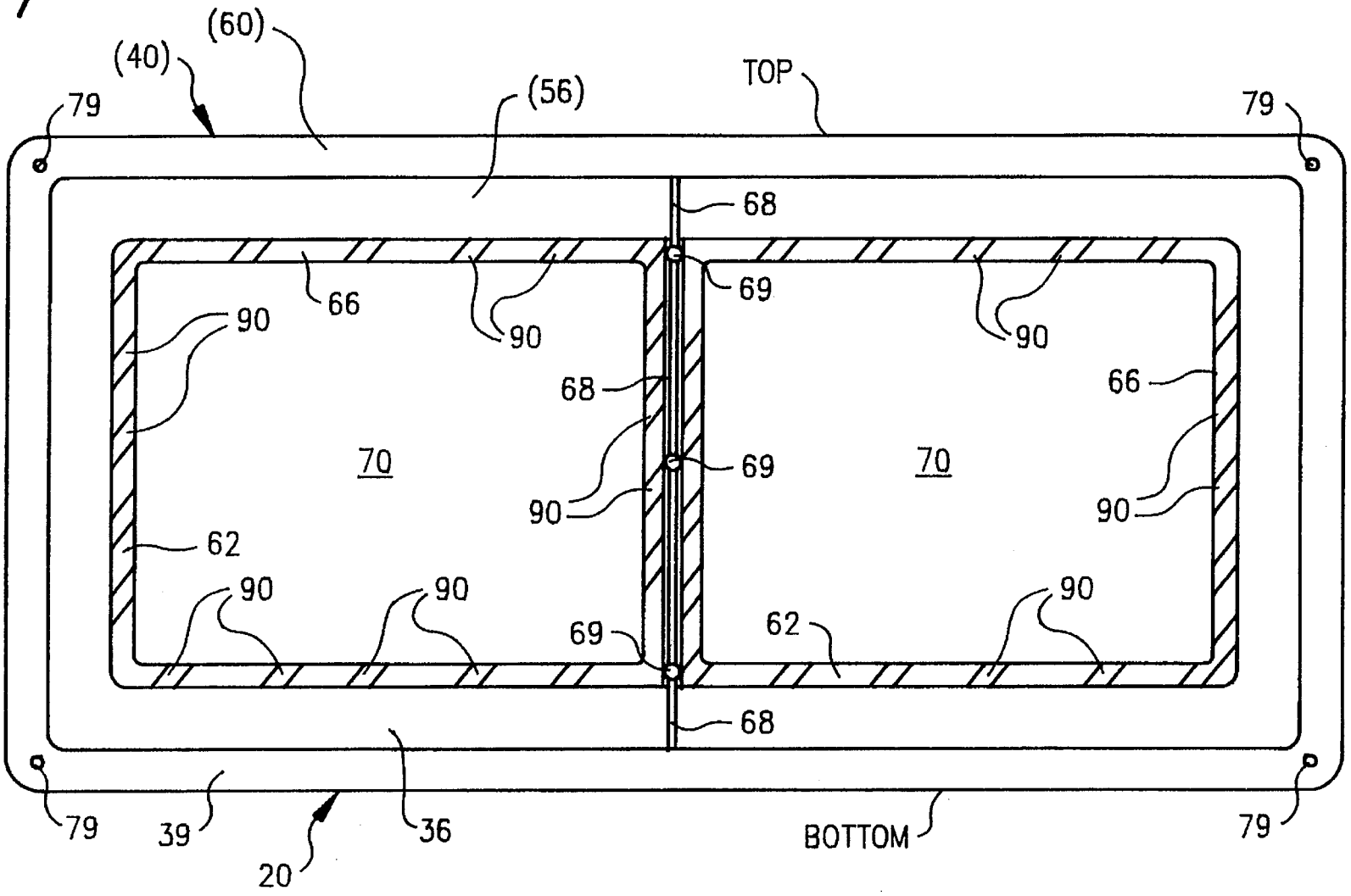
FIG. 7 is a rear elevation view of a unitary one-piece molded plastic foundation ventilator.

FIG. 7 is a rear elevation view of the foundation ventilator 20; the rear view of a larger ventilator such as ventilator 40 is virtually identical.

Since the front elevation view and the rear elevation view of the ventilators 20 and 40 are the same, those components common to both identified in FIGS. 6 and 7 so as to preclude a duplication of the drawings. For convenience, in FIGS. 6 and 7 ventilator 40 will be described by noting the corresponding reference numbers in parentheses.

As seen in FIGS. 6 and 7, it can be appreciated that ventilator 20 and (40) includes a set of middle inner flange portions 62 which, in cooperation with central vertical divider or support 68, defines a pair of through passageways or openings 70 for ventilation air to pass therethrough.

In FIGS. 6 an 7 it is seen that the vertically extending reinforcing divider 68 extends from front to back; that is, it starts at the front flange 22 (or 42) and extends to and connects with the rear flange 39 (or 60). The reinforcing divider also extends vertically for the full interior of the vent; that is it runs from the bottom of front flange 22 (or 42) and rear flange 39 (or 60) to the top of front flange 22 (or 42) to the top of rear flange 39 (or 60).

In the reinforcing divider 68 it is seen that there are a number (five are shown) of substantially circular rod portions 69. These rod portions 69 are a result of the selected plastic molding technique, and represent voids where liquid plastic was allowed to flow into the mold to make the ventilator 20 or the ventilator 40, and where the plastic was ultimately allowed to set in the position of rod portions 69. However, it should be noted that rod portions 69 provide additional structural strength, where it is needed, to stiffen the vertical divider 68 against deflection when the top of the ventilator 20 (or 40) is loaded with wet concrete.

In FIGS. 6 and 7, it is seen that the reinforcing divider 68 divides the ventilator into two sections or two through passageway 70 openings. The inner flange 62, a thin inwardly projecting portion located at or near the narrowest portion of the throat or middle portion of the through passageways 70, defines and encircles each of the passageway 70 openings at the periphery thereof. The inner flange 62 has a front surface 64, see FIG. 6, and has a rear surface 66, see FIG. 7.

In FIGS. 6 and 7 it is seen that in the front flange 22 (and 42) and in the rear flange 39 (and 60) that there are nail holes 79. These nail holes are for nailing the ventilator 20 (or 40) to the normally wooden form for used for receiving the concrete.

In FIG. 6 it is seen that in the front portion of the ventilators 20 (and 40), there are two spaced-apart positioning ledges 72. These ledges 72 are located in the lower part of the ventilator 20 (and 40). The positioning ledge 72 preferably extends from the front flange 22 (or 42) to the inner flange 62.

For each opening 70, there is positioned at the top of inner flange 62 and projecting just forward of front surface 64 of inner flange 62 two spaced-apart cover closure means 74 in each passageway 70. In other words, in this embodiment, there are four cover closure means 74. In the insert in FIG. 6 there is a side elevation view of the cover closure means 74 showing an forwardly projecting body 76 and rearwardly spaced attachment finger 78 which is affixed at the top thereof.

As illustrated in FIGS. 6 and 7, the ventilator 20 (or 40) may be considered to be divided into two sections, with each section comprising an opening 70. In FIG. 6 it is seen that on the inner flange 62, and inward from the positioning ledges 72 that there are two cover attachment points 80 below each opening 70. In other words, in this embodiment, there are four cover attachment points 80 in each ventilator 20 (or 40).

Figure 10:
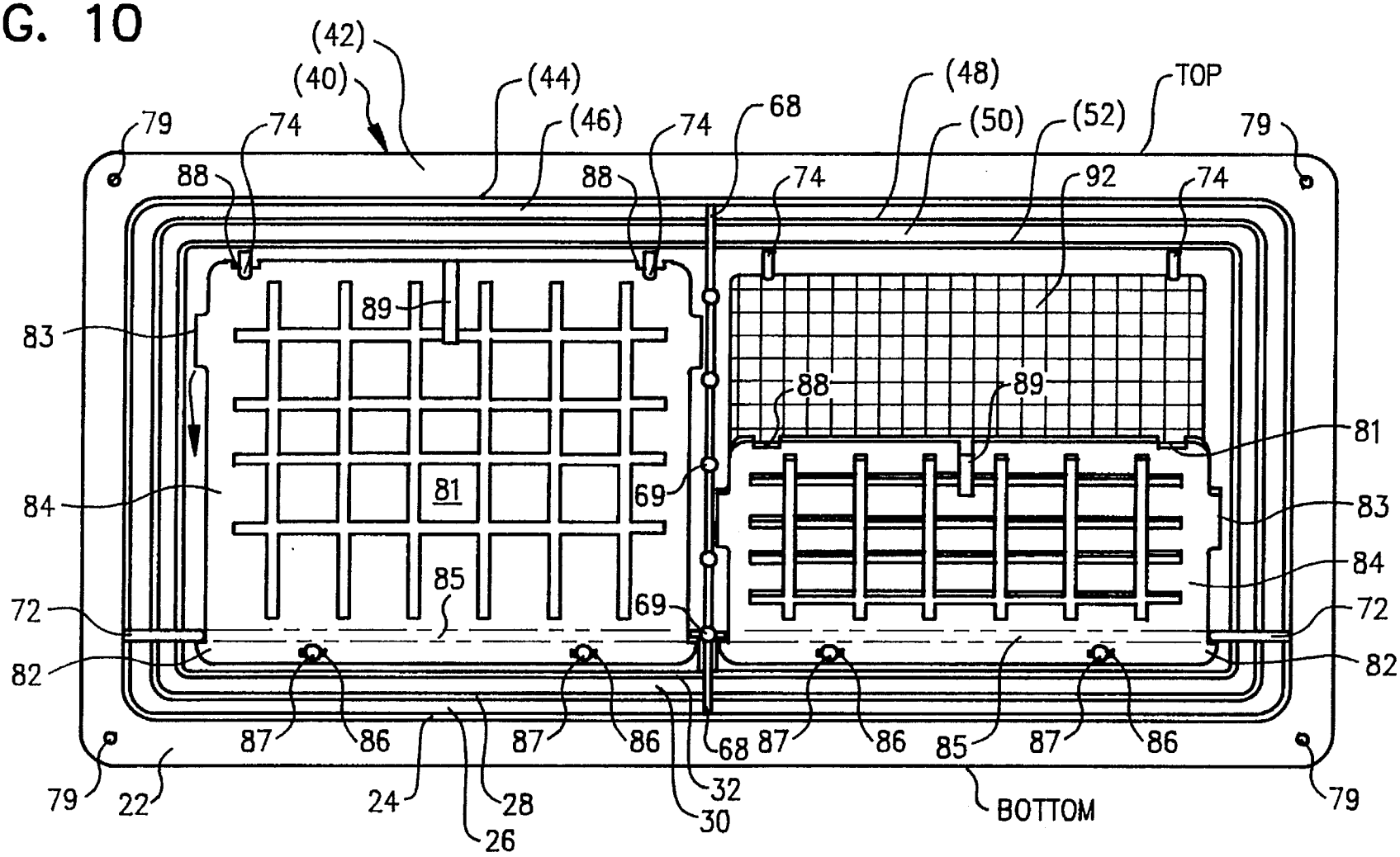
FIG. 10 is a front elevation view of a foundation ventilator, with an additional cover for each through passageway, and illustrating the cover in a closed position for one passageway, and illustrating another cover in an open position for a second passageway, so as to allow air circulation and ventilation.

Referring now to FIG. 10, a cover 81 is provided for each of the openings 70. As there are two openings 70 there are two covers 81. Each of the covers 81 comprises a fixed base portion 82 and a movable member 84. The movable member 84 can move with respect to the base 82 and therefore with respect to the ventilator. Preferably, the cover 81 moves forwardly and downwardly upon opening.

In the base 82 of cover 81, there are two spaced-apart slots 86 which may be used for fasteners 87 such as pop rivets to pass therethrough to affix the base 82 of covers 81 to the inner flange 62. On the upper edge of the movable member 84 there are two spaced-apart recesses 88. When the moveable member 84 is pressed upward to close cover 81, recesses 88 engage cover closure means 74, and, by slight deformation of cover 81, the cover 81 is snapped closed at recesses 88 behind closure means 74. This prevents the flow of air through the ventilator 20 (or 40). In other words, the catch 74 and the recesses 88 function as a lock to lock the movable member 84 over the opening 70 to preclude the flow of air.

To oven cover 81, the movable member 84 is pulled forward away from the catch 74 and rotated downward about hinge 85 toward the positioning ledge 72. The positioning ledge 72 will engage tab 83 to lock the movable member 84 in an open position to allow the flow of air through the ventilator 20 (or 40). In other words, the positioning ledge 72 functions as a lock to hold the movable member 84 in an open position.

To assist in rotating the movable cover member 84 away from opening 70 there is a handle 89 on the upper part of the movable member 84 and between the two recesses 88. A person wanting to rotate the movable member can grasp the handle 89 and pull the movable member away from the ventilator so as to expose the opening 70.

Returning now to FIG. 7, it is seen that on the rear surface 66 of the inner flange 62 that there are a number of raised plastic bumps or knobs 90. These plastic knobs 90 are slightly elevated above the rear surface 66 of flange 62. The function of these knobs 90 is seen by reference to FIG. 9, wherein the ventilator 20 (or 40) is shown with an additional screen 92 over the through passageway 70 openings. In manufacture, the screen 92 can be positioned over the openings 70 and next to the rear surface 66 of the inner flange 62. A heated screen 92 can pressed against the plastic knobs 90 of the rear surface 66. The thermoplastic knobs 90 will become soft or semi-liquid and deform so as to encase part of the screen. In this manner the screen can be firmly embedded in the plastic knobs 90 and thus securely affixed and positioned over the opening 70. The screen 92 is quite useful in that it precludes large insects and small animals from passing through the opening 70 in the ventilator to enter the crawl space, as well as precludes other objects such as toys or leaves from passing through the opening 70 so as to become positioned under the frame building.

Figure 8:
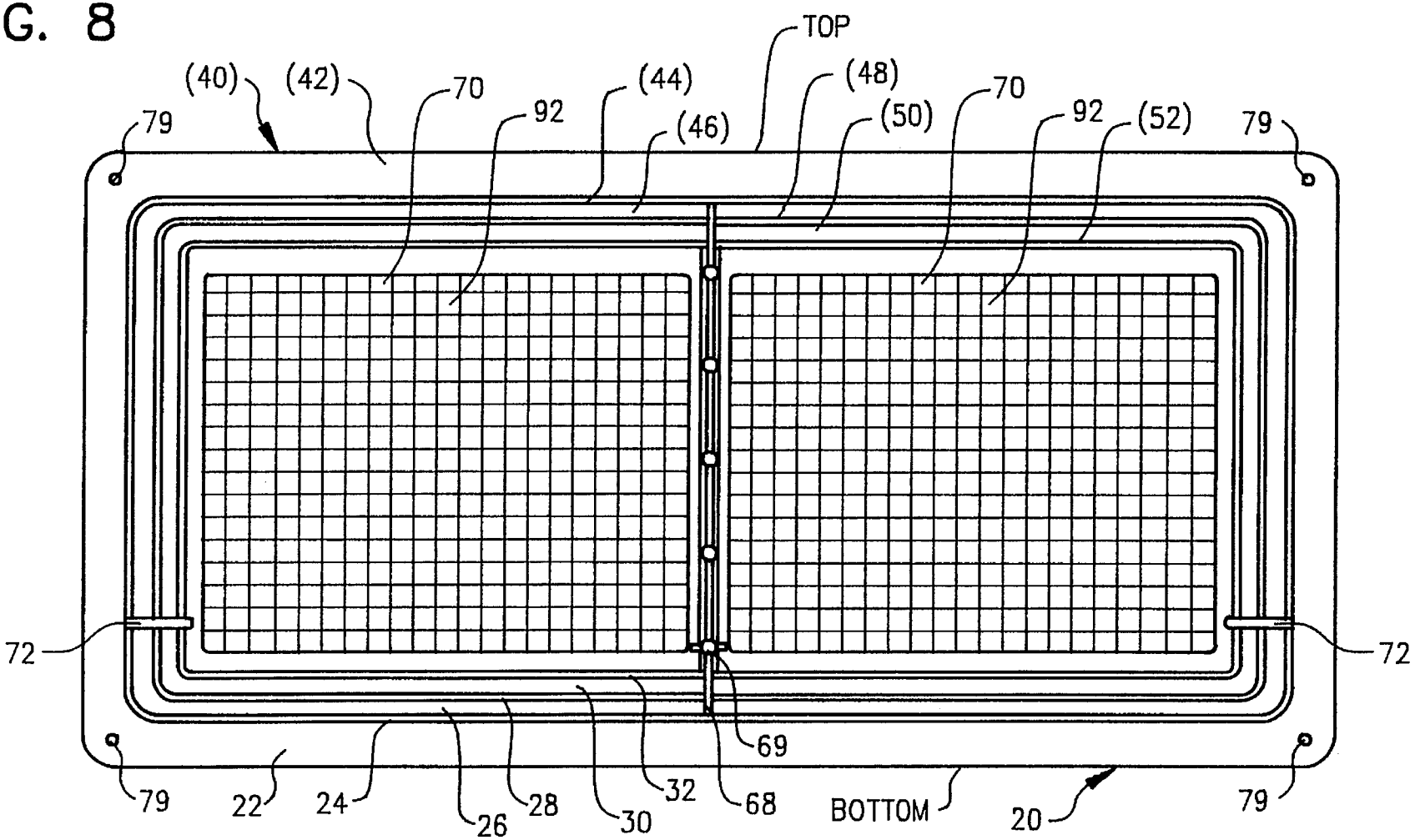
FIG. 8. is a front elevation view of the unitary one-piece molded plastic foundation ventilator with an accompanying screen.
Figure 9:
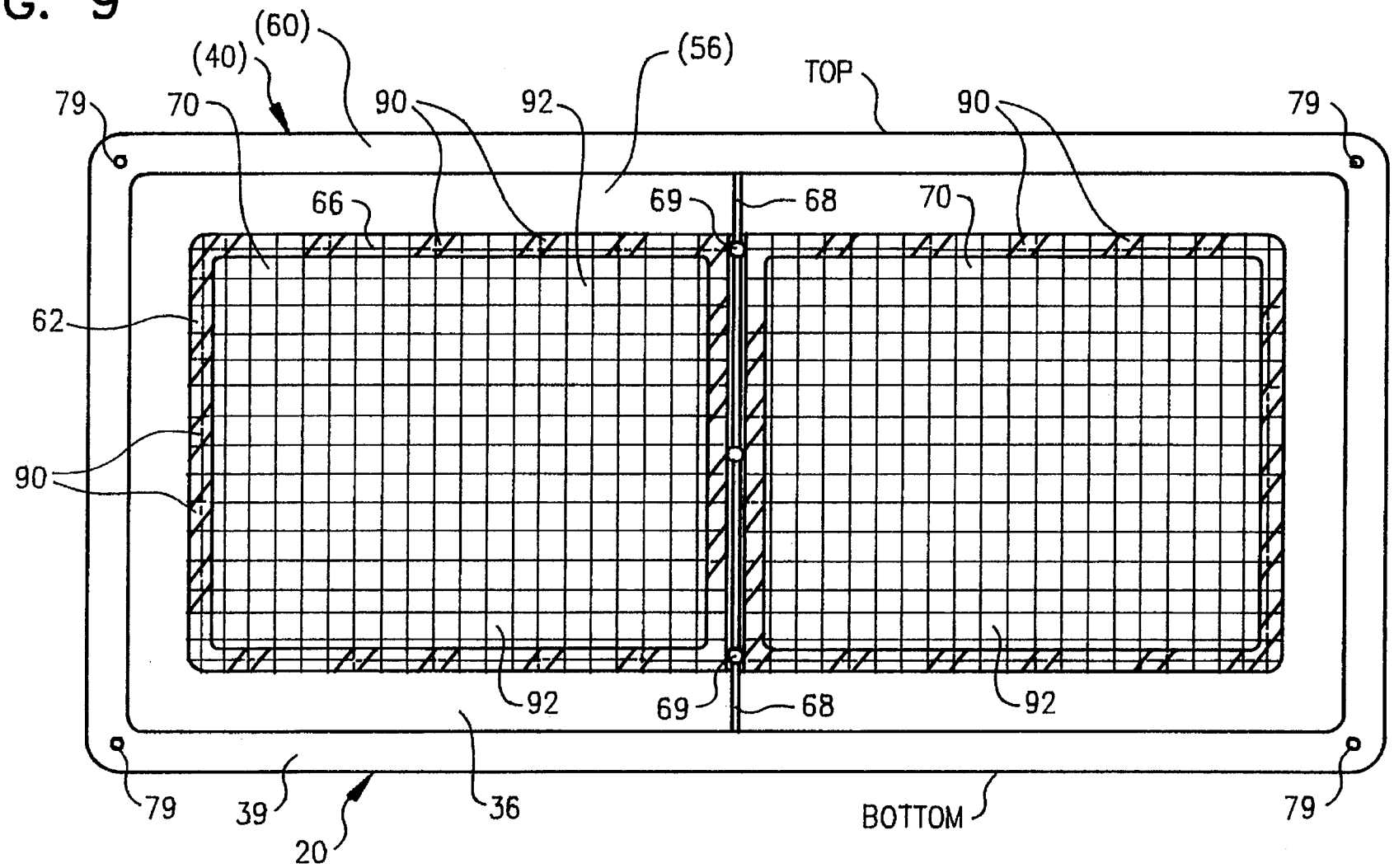
FIG. 9 is a rear elevation view of a unitary one-piece molded plastic foundation ventilator with an additional screen.

Complementary to the just discussed FIG. 9, a front elevation view of a ventilator including a screen 92, but without a cover 81, is shown in FIG. 8. That is, the front of a ventilator 20 (or 40) may appear as in FIG. 8, without a cover, or as in FIG. 10, with a cover 81 suitable for positioning over each through passageway 70.

Figure 1:
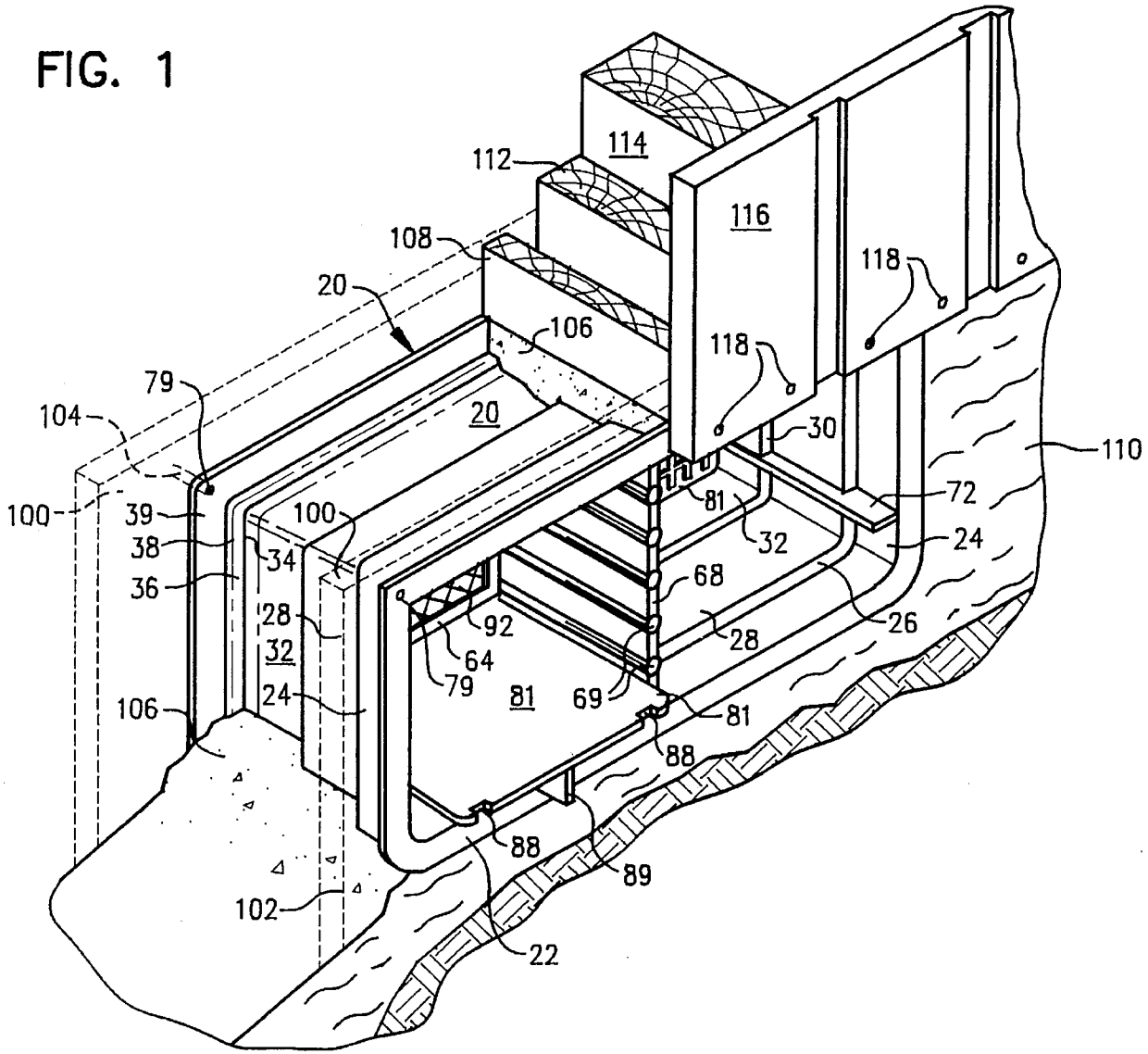
FIG. 1 is a partially broken away front perspective view of a one-piece molded plastic foundation ventilator in a stem wall; the concrete is partially broken away to reveal details of the foundation ventilator installation.

Now that the details of the one-piece molded plastic ventilator are understood, attention is directed to FIG. 1. FIG. 1 shows a perspective view of the ventilator 20 in a form for receiving uncured concrete for the formation of a stem wall. The form is a wooden form, shown in phantom, with a rear portion 100 and a front portion 102. Nails 104 can be driven through the nail holes 79 and into the wooden form 100 and 102 so as to, definitely, position the ventilator 20 with respect to the wooden form 100 and 102 to allow concrete to be poured around the ventilator 20. In time, the concrete will set, and the wooden form 100 and 102 can be removed.

In FIG. 1 it is seen that there is concrete 106 poured around the ventilator 20 and around the inward sloping sides in the inward edges of the ventilator. The concrete 106 is in a fluid or plastic state when it is poured around the ventilator. Then, when the concrete 106 sets, it hardens and becomes a solid, and over time, cures. Also, in FIG. 1, there is shown a mud plate 108 placed on top of the concrete 106 of the stem wall 110. There is a floor joist 112 on top of the mud plate 108. Further, a sill 114 is placed on top of the floor joist 112. Also, wall sheeting 116 is placed or positioned outwardly from the plate 108 by means of nails 118. Usually, the wall sheeting 116 extends downwardly over the front outwardly directed flange 22 of the ventilator 20.

In FIG. 1, it is seen that the cover 81 is lowered in the left through passageway 70 part of the ventilator 20 so as to allow the passage of air through the opening 70 in the ventilator 20. In the right part of the ventilator 20 the cover 81 is in an elevated or closed position to close the right opening 70 and to preclude the passage of air through the opening.

With the ventilator 20 being normally at least six inches deep, there is only a slight possibility, when the cover 81 is in a lower position so as to allow the passage of air through the ventilator, that rainwater could enter the ventilator 20 and pass through the screen 92 and thus pass through the stem wall 110 and underneath the frame building. The ventilator 20 does, inherently, present a barrier to the flow of water through the ventilator 20, in the embodiments taught herein, as the decreasing cross-sectional area provided by inward ringlike sides 24, 28, 32 (etc.) are at higher and higher elevations, thus providing outward flow of water, rather than inward.

It is also a feature of the present design that the cover 81 is self storing and is therefore always on or attached to the ventilator 20. In winter, the cover 81 can be placed in an elevated position so as to close the opening 70 of the ventilator 20 and therefore preclude the flow of air through the ventilator 20. In summer, the cover 81 can be in an open position so as to allow the flow of air through the opening 70 of the ventilator 20.

From the foregoing, it is seen that we have provided a superior ventilator made of one piece of plastic, thereby avoiding seams and providing high strength with minimum weight and cost. Injection molding can be used to form a one piece molded continuous uninterrupted plastic foundation ventilator. With the proper die and the proper plastic it is possible to make a one-piece unitary molded continuous uninterrupted plastic foundation ventilator which in effect is a tubular member having a plurality of sides of various cross-sectional dimensions which results in a continuous plastic tubular ventilator having two openings for allowing a passage of air. Therefore, it is to be appreciated that the one-piece molded plastic ventilator provided by the present invention is an outstanding improvement in the state of the art of ventilator fabrication. The process of manufacture of the ventilator is relatively simple, and the resulting ventilator substantially reduces the labor and materials required for production of ventilators when compared to prior two-piece ventilator construction.

It is thus clear from the heretofore provided description in conjunction with the drawing that the present ventilator invention, although simple, is a dramatic improvement in the state of the art in ventilators. It will be readily apparent to the reader that the present invention may be easily adapted to other embodiments incorporating the concepts taught herein and that the present figures are shown by way of example only and not in any way a limitation. Thus, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalences of the claims are therefore intended to be embraced therein.

We claim:

1. A foundation ventilator, said ventilator comprising:

a. a jointless, continuous one-piece plastic tubular member having a first through passageway;

b. said plastic tubular member having a front and a rear; and c. wherein said first through passageway of said ventilator further comprises a middle portion between said front and said rear, said middle portion (1) having a smaller cross-sectional dimension than said front, and (2) having a smaller cross-sectional dimension than said rear, whereby said smaller cross-sectional dimension of said middle portion results in an upward gradient from said front toward said rear of said vent when said vent is installed in an operative condition, so that any water impinging on said vent cannot flow from said front toward said rear by gravity.

2. The foundation ventilator of claim 1, further comprising:

a. a reinforcing divider, b. said reinforcing divider defining in said ventilator (a) said first through passageway, and (b) a second through passageway.

3. The foundation ventilator of claim 1, wherein said front further comprises an outwardly directed front flange.

4. The foundation ventilator of claim 1, wherein said rear further comprises an outwardly directed rear flange.

5. The foundation ventilator according to claim 1, further comprising:

a. a circumscribing first side, said first side extending substantially in the through passageway direction from said front flange to and uniting with a first inward ledge;

b. by said first inward ledge extending to and uniting with a circumscribing second side;

c. said circumscribing second side extending substantially in the through passageway direction and extending to and uniting with a second inward ledge.

6. The foundation ventilator according to claim 5, further comprising:

a. a circumscribing third side, and b. a circumscribing fourth side, c. wherein said third and said fourth sizes extend substantially in the through passageway direction.

7. The foundation ventilator according to claim 6, wherein said third side and said fourth side extend to and unite each with the other.

8. The foundation ventilator according to claim 7, further comprising a first outer ledge, wherein said first outer ledge extends between and unites said third side and said fourth side.

9. The foundation ventilator according to claim 8, or claim 8, further comprising:

a. a circumscribing fifth side, said fifth side extending substantially in the through passageway direction, and b. a final outer ledge, c. wherein said final outer ledge extends between and unites said fourth side and said fifth side.

10. The foundation ventilator according to claim 9, further comprising a rear flange, said rear flange extending from and uniting with said fifth side.

11. The foundation ventilator according to claims 5 or 6, wherein each of said circumscribing sides further comprises a bottom portion, said bottom portion is sloped downwardly and outwardly from said middle portion, in the through passageway direction.

12. A foundation ventilator according to claim 2, further comprising:

a. an inner flange, said inner flange having a front surface and a rear surface, wherein b. said inner flange is located laterally at the periphery of said first through passageway, and, in the through passageway direction, in said middle portion.

13. A foundation ventilator according to claim 12, further comprising plastic knobs, said knobs located on said rear of said inner flange.

14. A foundation ventilator according to claim 13, further comprising:

a. a porous member, and b. wherein said porous member is affixed to said inner flange of said ventilator by the process of (i) heating said knobs to a thermoplastic, deformable condition, (ii) then pressing said porous member and said knobs together until said porous member becomes embedded in said knobs by the deformation thereof, (iii) then allowing said knobs to cool to a solid condition;

c. (iv) wherein said porous member is adapted to allow the passage of a gas and to preclude the passage of a solid therethrough.

15. The ventilator of claim 14, wherein said porous member comprises a metal screen.

16. A foundation ventilator according to claim 2, further comprising:

a. an inner flange in said middle portion of said through passageway;

b. said inner flange laterally encircling said first through passageway;

c. said inner flange laterally encircling said second through passageway; and, d. said inner flange having a front surface and a rear surface.

17. A foundation ventilator according to claim 16, further comprising:

a. a cover for said first through passageway;

b. a hinge means, said hinge means affixed to said front surface;

c. said cover operatively connecting with said hinge means so as to permit said cover to move forwardly to an open position.

18. A foundation ventilator according to claim 17, further comprising:

a. a catch, said catch located adjacent to said front surface for operatively interacting with said cover to secure cover at a closed position so as to prevent airflow through said first passageway.

19. A foundation ventilator according to claim 17, further comprising:

a. a positioning ledge, said positioning ledge located at the outer side of said first through passageway, said positioning ledges also running substantially in the through passageway direction;

b. a tab means, said tab means laterally disposed on said cover;

c. said positioning ledge juxtapositioned to said hinge means for operatively interacting with said tab means of said cover so as to secure said cover in an open position to allow the flow of gas through said first through passageway.

20. A foundation ventilator as set forth in claim 1, wherein the thickness of said ventilator in the through passageway direction is approximately six (6) inches.

21. A foundation ventilator as set forth in claim 1, wherein the thickness of said ventilator in the through passageway direction is approximately eight (8) inches.

* * * * *

UNITED STATES PATENT AND TRADEMARK OFFICE

CERTIFICATE OF CORRECTION

PATENT NO. : 5,460,572

DATED : October 24, 1995

INVENTOR(S) : Arthur L. Walts and David A. Walts

It is certified that error appears in the above-identified patent and that said Letters Patent is hereby corrected as shown below:

In column 11, line 42, after "b" delete "by".

In column 11, line 60, after "claim" delete "8" and insert --7--.

Signed and Sealed this

Twentieth Day of May, 1997

*Attest:*

Bruce Lehman

BRUCE LEHMAN

*Attesting Officer*

*Commissioner of Patents and Trademarks*